US011111617B2

(12) United States Patent
Se-Je

(10) Patent No.: US 11,111,617 B2
(45) Date of Patent: Sep. 7, 2021

(54) GATHERING SEWING MACHINE AND METHOD

(71) Applicant: NIKE, Inc., Beaverton, OR (US)

(72) Inventor: Cho Se-Je, Busan (KR)

(73) Assignee: NIKE, Inc., Beaverton, OR (US)

( * ) Notice: Subject to any disclaimer, the term of this patent is extended or adjusted under 35 U.S.C. 154(b) by 127 days.

(21) Appl. No.: 16/347,136

(22) PCT Filed: Nov. 21, 2017

(86) PCT No.: PCT/US2017/062836
§ 371 (c)(1),
(2) Date: May 2, 2019

(87) PCT Pub. No.: WO2018/094402
PCT Pub. Date: May 24, 2018

(65) Prior Publication Data

US 2020/0071868 A1 Mar. 5, 2020

Related U.S. Application Data

(60) Provisional application No. 62/424,880, filed on Nov. 21, 2016.

(51) Int. Cl.
*D05B 27/18* (2006.01)
*D05B 15/02* (2006.01)
*D05B 47/00* (2006.01)

(52) U.S. Cl.
CPC ..... *D05B 15/02* (2013.01); *D05B 27/185* (2013.01); *D05B 47/00* (2013.01)

(58) Field of Classification Search
CPC ..... D05B 15/02; D05B 27/185; D05B 47/00
See application file for complete search history.

(56) References Cited

U.S. PATENT DOCUMENTS 268,215 A 11/1882 French
766,779 A 8/1904 Stuart
(Continued)

FOREIGN PATENT DOCUMENTS

CN 101381931 A 3/2009
CN 104233635 A 12/2014
(Continued)

OTHER PUBLICATIONS

International Preliminary Report on Patentability dated May 31, 2019 in International Patent Application No. PCT/US2017/062836, 9 pages.
(Continued)

*Primary Examiner* — Tajash D Patel
(74) *Attorney, Agent, or Firm* — Shook, Hardy & Bacon LLP

(57) ABSTRACT

A sewing machine and a method of operating a sewing machine able to gather one or more materials through a variable speed transfer disc or transfer cup. The gathering operation can assist in joining materials of different lengths without causing a warp or other unintended variation in the sewn article. The gathering operation may be used in connection with sewing of an article of footwear upper with an insole portion to form a foot-receiving cavity. During a sewing operation, a tension on the thread may be adjusted and confirmed with a display output. Similarly, an indication of pressure applied to decrease a rotational speed of the transfer disc or the transfer cup may be presented on a display output to achieve repeatability across operators and articles.

18 Claims, 6 Drawing Sheets

(56) References Cited

U.S. PATENT DOCUMENTS

| | | | | | |
|---|---|---|---|---|---|
| 1,036,523 | A | | 8/1912 | Lange | |
| 2,603,173 | A | * | 7/1952 | Olleo, Sr. | D05B 27/18 112/16 |
| 2,664,840 | A | * | 1/1954 | Joseph | D05B 51/00 112/274 |
| 3,496,892 | A | | 2/1970 | Nerino | |
| 3,738,298 | A | * | 6/1973 | Albrecht | D05B 47/00 112/254 |
| 3,834,331 | A | | 9/1974 | Raisin et al. | |
| 3,978,802 | A | * | 9/1976 | Hamlett | D05B 47/00 112/254 |
| 3,994,246 | A | | 11/1976 | Boser | |
| 5,228,162 | A | * | 7/1993 | Wu | D05B 15/02 112/258 |
| 8,997,669 | B1 | * | 4/2015 | Konzak | D05B 47/04 112/254 |
| 2014/0238081 | A1 | | 8/2014 | Meir et al. | |
| 2016/0122929 | A1 | | 5/2016 | Koike et al. | |
| 2018/0274147 | A1 | * | 9/2018 | Suzuki | D05B 47/04 |

FOREIGN PATENT DOCUMENTS

| | | | |
|---|---|---|---|
| DE | 1922505 | A1 | 11/1970 |
| DE | 9116273 | U1 | 8/1992 |
| DE | 19539676 | A1 | 5/1996 |
| GB | 197893 | A | 5/1923 |
| GB | 2076865 | A | 12/1981 |
| JP | S62268589 | A | 11/1987 |
| JP | 10-173657 | A | 6/1998 |
| KR | 10-1495010 | B1 | 2/2015 |
| KR | 20-0478819 | Y1 | 11/2015 |
| RU | 2064545 | C1 | 7/1996 |
| WO | 2018094402 | A1 | 5/2018 |

OTHER PUBLICATIONS

International Search Report and Written Opinion dated Feb. 16, 2018 in International Patent Application No. PCT/US2017/062836, 17 pages.

Main parameters of 9.2.2 cylinder, Nov. 30, 2016, 2 pages (1 page of English Translation and 1 page of Official copy).

Sewing Machine Control System, Chapter 8, Mar. 31, 2013, 10 pages (3 pages of English Translation and 7 pages of Official Copy).

Office Action received for European Patent Application No. 17812167.9, dated Apr. 30, 2021, 5 pages.

* cited by examiner

GATHERING SEWING MACHINE AND METHOD

CROSS-REFERENCE TO RELATED APPLICATIONS

This application is a 35 U.S.C. § 371 national stage application of PCT Application Number PCT/US2017/062836, filed Nov. 21, 2017, and entitled "Gathering Sewing Machine and Method", which claims the benefit of U.S. Application 62/424,880, filed Nov. 21, 2016, and entitled "Gathering Sewing Machine and Method". The entirety of the aforementioned is incorporated by reference herein.

FIELD OF THE INVENTION

A sewing machine.

BACKGROUND OF THE INVENTION

Sewing machines traditionally transfer a first and a second material at a constant rate for a sewing operation.

BRIEF DESCRIPTION OF THE DRAWING

Exemplary aspects are described in detail herein with reference to the attached drawing figures, which are incorporated herein by reference, wherein.

DETAILED DESCRIPTION OF THE INVENTION

Figure 1:
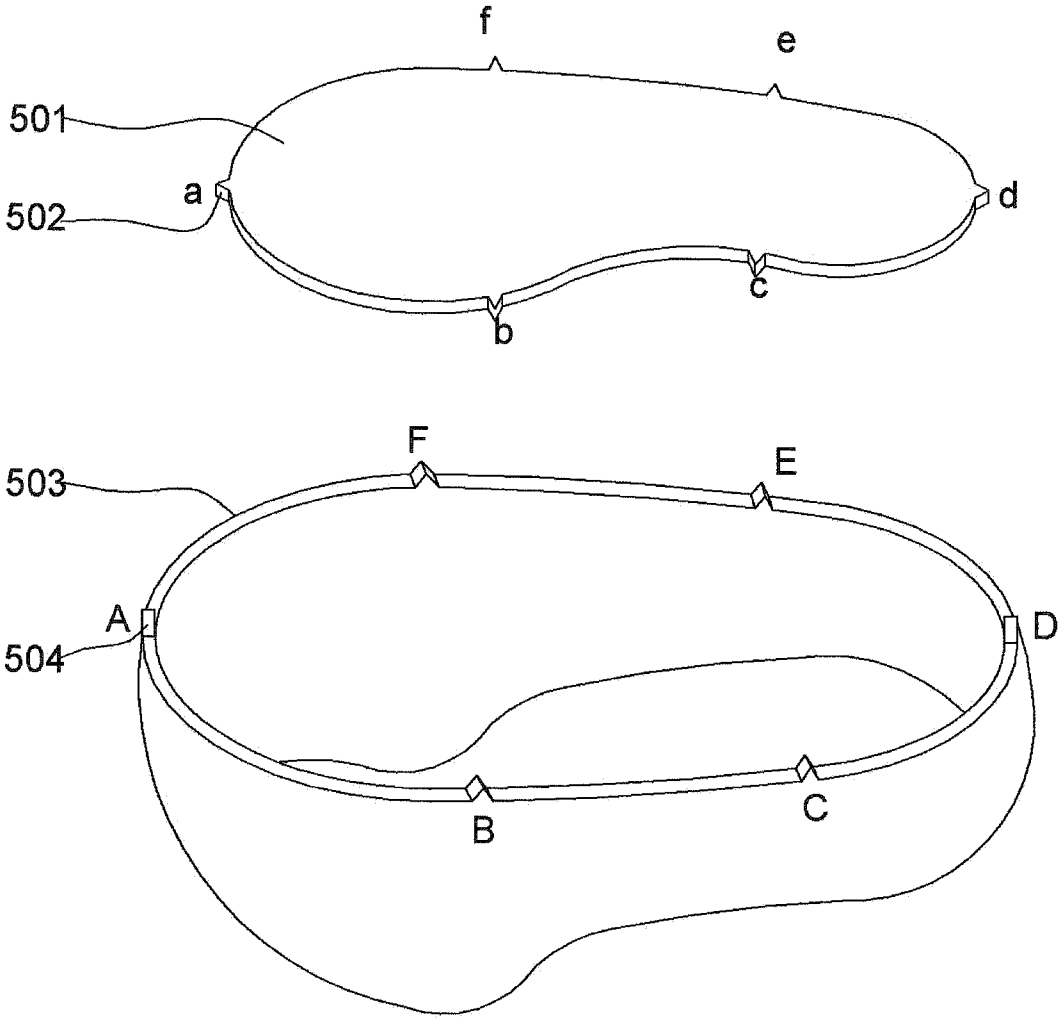
FIG. 1 is a perspective view showing an insole and an upper of an article of footwear, in accordance with aspects hereof.

Subject matter is described throughout this disclosure in detail and with specificity in order to meet statutory requirements. But the aspects described throughout this disclosure are intended to be illustrative rather than restrictive, and the description itself is not intended necessarily to limit the scope of the claims. Rather, the claimed subject matter might be practiced in other ways to include different elements or combinations of elements that are equivalent to the ones described in this disclosure. In other words, the intended scope of the invention includes equivalent features, aspects, materials, methods of construction, and other aspects in embodiments not expressly described or depicted in this application in the interests of concision, but which would be understood by an ordinarily skilled artisan in the relevant art in light of the full disclosure provided herein as being included within the inventive scope. It will be understood that certain features and subcombinations are of utility and may be employed without reference to other features and subcombinations. This is contemplated by and is within the scope of the claims.

At a high level, this disclosure generally provides a sewing machine having a thread tensioner that is adjustable by operator input to adjust the tension of a thread used for sewing. The adjustment of the thread tensioner may be digitally controlled such that an operator may provide an input (e.g., selection of a tension at a control interface) and a separate physical force acts on the thread tensioning elements to achieve the thread tension. For example, an operator may turn a knob or interface with a digital display to set a desired thread tension level. In response, an actuator, such as a pneumatic cylinder, may change position causing one or more elements (e.g., pressing part) to move relative to another element (e.g., tightening plate). The relative movement of the pressing part by the pneumatic cylinder in this situation imparts a frictional resistance to the feeding of the thread through the thread tensioner, which imparts a tension on the thread for the sewing operation. As will be discussed, the thread tensioner with an operator input that is mechanically separate from the tension-inducing element itself allows for an operator to set a tension and the thread tensioner may maintain that tension level regardless of thread material or other parameter changes to the sewing machine.

Other aspects herein include a gathering assembly. The gathering assembly is effective to differentially feed (e.g., transfer) two distinct materials through the sewing machine to be sewn with each of the material fed at a different rate, which allows for a gathering of one or more of the materials during the sewing operation. This gathering process is advantageous for at least uniformly joining two materials having different edge lengths to form a curved product with a substantially linear seam. For example, when joining an insole with an upper for an article of footwear, sewing the insole and the upper at a curved portion of the toe end or heel end result in the upper having a longer sewn edge than the insole. As such, an operator on a traditional machine physically restricts the feed of the shorter insole edge to cause a gathering of the upper edge to compensate for the longer upper edge. This manual restriction by the operator requires strength and experience to generate a uniform stitch and gather along the curved portion of the insole (e.g., toe end and heel end). The gathering assembly provided hereinafter transfers the burden of gathering one of the materials from the operator to the device in a controlled and consistent manner.

The gathering assembly may be adaptable to different perimeter configurations by use of a brake assembly. The brake assembly mechanically engages with the transfer disc of the gathering assembly to variably adjust rotational speed of the transfer disc through frictional interaction. Engagement and disengagement of the brake assembly allows for a varied transfer (e.g., feed) speed/rate of materials through the gathering assembly. For example, as the brake assembly is engaged, the material in contact with the transfer disc may pass through the gathering assembly at a slower speed than the material in contact with the transfer cup. As such, the non-uniform transfer speeds allow for the gathering of the faster-fed material as the two materials are subsequently stitched together by the sewing machine. Therefore, by an operator manipulating the brake assembly, the operator is able to control the amount and relative position of the gathering of the materials during the sewing operation. A use example includes allowing an operator to gather upper material as a toe portion of an article of footwear is sewn and also not gathering the upper material when sewing the medial or lateral portions of the article of footwear in a continuous sewing operation.

Additionally, aspects contemplate a speed adjusting assembly. The speed adjusting assembly allows for a variable speed of the transfer cup. For example, as the brake assembly applies resistance to the transfer disc for a gathering operation, the reduced feed rate of the material contacting the transfer disc may translate to the material contacting the transfer cup. As a result, the transfer cup may slow as well in response to the resistance, which may negate the effect of the differential speed intent of applying the brake assembly. In response, the speed adjusting assembly, which may have a clutch incorporated therein, may adjust a speed of the transfer cup to maintain or increase a speed thereof to offset the resistance caused by application of the brake assembly, in an exemplary aspect.

Further, it is contemplated that one or more digital displays may be implemented to provide quantitative indicators of force application. For example, a thread tension display may provide an indication of tension applied to a thread, which allows for repeatability from one operator to another in an exemplary aspect. Similarly, a gathering display may be included that provides an indication of pressure (e.g., braking force) applied by the brake assembly. Therefore multiple operators may produce a similar finished good based on a coordination of pressure applied at defined location of an article. For example, when sewing an article of footwear, operators may be instructed to maintain a defined range of pressure application in a toe region, in a heel region, in a medial region, and/or in a lateral region of the article of footwear. This monitoring of pressure applied by the brake assembly may increase uniformity of a sewing operation across different operators.

In use, it is contemplated that aspects provided herein may be adapted to sew two or more components in the formation of an article of footwear (e.g., shoe). For example, an insole (e.g., a strobel board) forming an under-foot portion of the footwear may be sewn with a lower perimeter of an upper to form a foot-receiving cavity of the footwear. This stitching operation is sometimes referred to as a "strobel stitch". An upper may have a longer edge to be joined than the insole edge to be joined. As such, a gathering operation to absorb and integrate excess edge length of the upper may be performed during the stitching operation. This gathering may be used in a toe region and/or a heel region, for example.

Aspects provided herein relate to a sewing machine for shoemaking able to gather materials and control tension of sewing yarns thereof, in which outer peripheral portions of footwear insoles and uppers are integrally formed (e.g., sewn) with each other by matching and sewing the outer peripheral portions thereof having different lengths from each other. The gathering and variable tensioning allows for the joining of the different length perimeters with greater efficiency and greater material uniformity as compared to traditional sewing machines, in an exemplary aspect.

An exemplary aspect includes a sewing machine comprising a thread tensioner having a tightening plate and a pressing part. The pressing part is adjustably positioned relative to the tightening plate to allow adjustment of a tension experienced by a thread extending between the pressing part and the tightening plate. The sewing machine is also comprised of a gathering assembly having a transfer cup and a transfer disc between which an intended article to be sewn is able to pass. Further, the sewing machine is comprised of a brake assembly that is mechanically engaged with the transfer disc to variably adjust rotational speed of the transfer disc through frictional interaction.

An additional aspect contemplates a method of sewing that includes transferring a first material and a second material through a gathering assembly comprised of a transfer cup and a transfer disc. The method continues with applying a brake to the transfer disc. The brake applying frictional interaction to reduce a transfer speed of the second material relative to a transfer speed of the first material. The method includes stitching the first material with the second material while applying the brake and then reducing an application of the brake to the transfer disc. The first material and the second material having the same transfer speed when the application of the brake is reduced. The method further comprises stitching the first material with the second material while reducing an application of the brake.

Additionally, aspects herein reduce warping of a sewn footwear product that traditionally are experienced due to sewing inaccuracies occurring during sewing the uppers whose outer peripheral portions are larger than the insoles while the outer peripheral portions thereof are not accurately matched with each other. Further, the controlled tensioning of aspects hereof prevents uncontrolled or unspecified pressure/tension applied to components to be sewn. This variability in tension is compounded by inexperienced operators attempting to join components of footwear. As such, the controlled, but variable, tension provides a greater level of uniformity in the resulting sewn article. Aspects hereof also increase the reliability and consistency of the sewn article. For example, historically variable sewing thread/yarn tensions cause stiches to be loose or tight without intention based on the operator's technique and experience or the materials to be sewn.

As provided in greater detail hereinafter, aspects contemplate physical markers (e.g., perimeter elements) on both the upper and the insole (e.g., a strobel board). The markers improve sewing accuracy by allowing alignment of the insole and upper during the sewing operation at multiple points along the joined perimeters. When the perimeter of the upper is greater than the perimeter of the insole to be joined therewith, the markers further help ensure an appropriate gathering of excess material along the appropriate portions of the perimeter.

Application of pressure to a transfer disc may be displayed on a pressure display monitor (also referred to as a gathering display herein) when sewing the upper and insole, which provide quantitative feedback to the operators during the sewing operation. This information confirms to the operator an amount of pressure being applied to the transfer disc and allows the operator to make an adjustment to the pressure. The adjustment, as will be discussed hereinafter, may be changed by manipulating an operator input, such as a pressure control button and/or a gathering assembly input pedal that allows for an increase or decrease in the pressure. This adjustment to specified levels allows for consistency between operators, products, and materials.

Aspects also contemplate increasing a rotational force of a transfer cup opposing the transfer disc. For example, as pressure is increased to the transfer disc, an increase in rotational force exerted by the transfer cup may be applied to ensure a consistent article from a sewing operation. Therefore, as pressure experienced by the transfer disc is changed by intention (e.g., operator adjustment by engagement of the brake assembly) or by circumstances (e.g., material variations), aspects contemplate adjusting a rotational force that is applied by the transfer cup. The rotational force may be operator controlled or correlated to the pressure experienced by the transfer disc, in exemplary aspects.

Sewing non-uniformity, in which the sewing yarns are tightly or loosely sewn depending on the material of the sewn product or the habits of the operator when sewing the insoles and the uppers of shoes, may be reduced with aspects hereof by uniformly controlling the tension of the sewing yarns based on the product being sewn. This results in a product having more uniform sewing quality.

Further, because the pressure applied to the upper and insole may be displayed during the sewing operation and the tension of the sewing yarns is also displayed, aspects hereof allow for the sewing yarns to be supplied to a single sewn product with a uniform tension. Controlling the tension of the sewing yarns according to the material of the sewn product or by the displayed pressure may be achieved in aspects hereof by an operator adjusting one or more inputs, such as a dial, button, or the like.

As will discussed in connection with the figures hereinafter, the following is a listing of parts provided in FIGS. 1-6.

101: transfer cup,
102: central shaft,
103: one-way clutch,
104: connecting part,
105: movement part,
106: swing part,
107: driving shaft,
108: wheel,
109: moving part,
111: displacement adjustment part,
112: adjustment axis,
113: adjustment part,
114: connecting pin,
115: piston,
116: first cylinder,
117: pressure control button,
201: transfer disc,
202: rotation axis,
203: brake device,
204: brake pad,
205: connecting axis,
206: connecting pin,
207: central pin,
208: piston,
209: second cylinder,
211: pressure display monitor,
212: operation pedal,
301: third cylinder,
302: piston,
303: support tube,
304: elastic member,
305: support,
306: tightening plate,
307: pressing part,
308: tension display monitor,
309: tension control button,
401: sewing machine,
402: looper,
403: transfer rod,
404: sewing needle,
405: guide plate,
501: insole,
502, 504: marker,
503: upper of shoes, and
505: sewing yarn.

Figure 2:
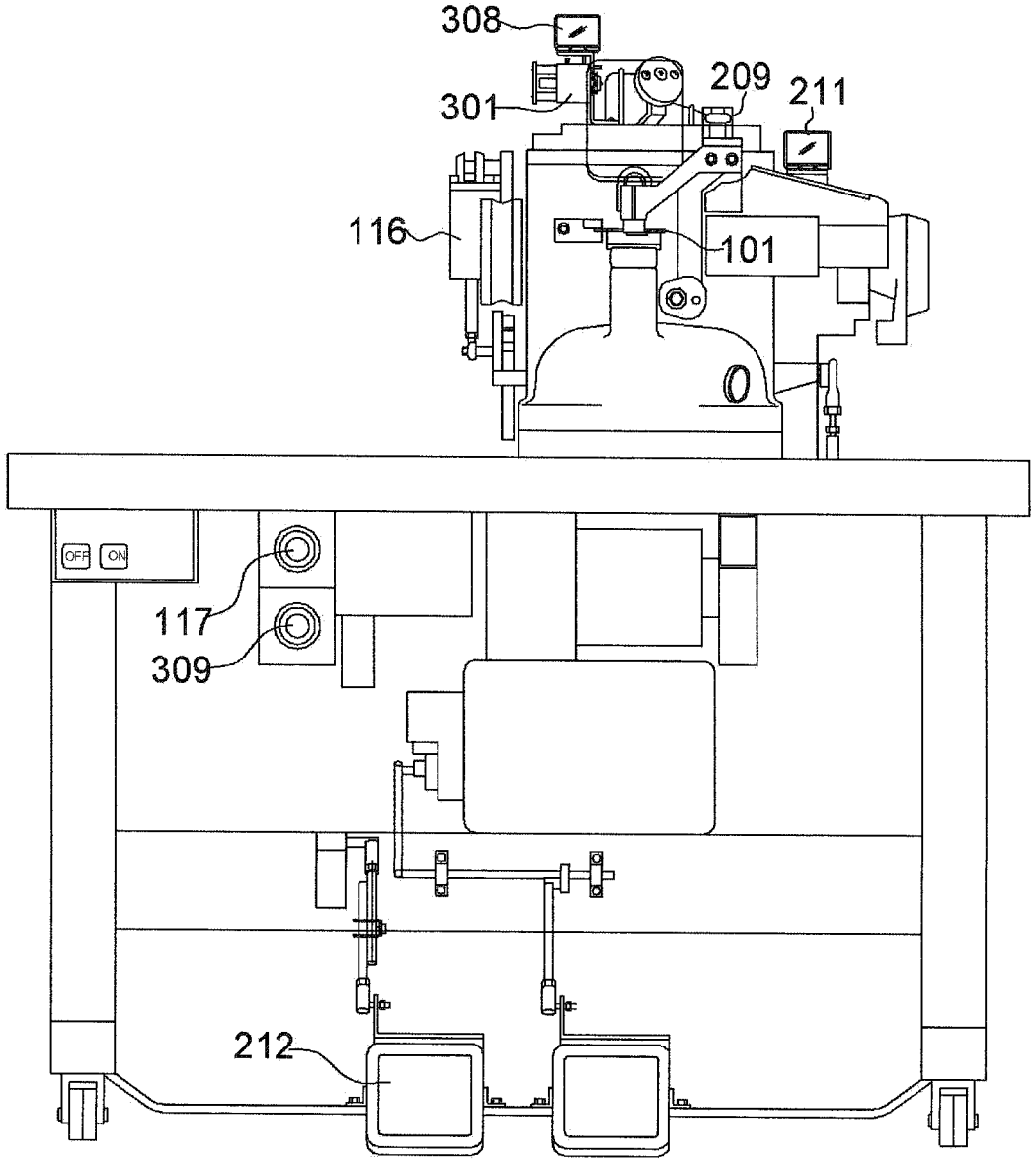
FIG. 2 is a front view of a sewing machine, in accordance with aspects hereof.
Figure 3:
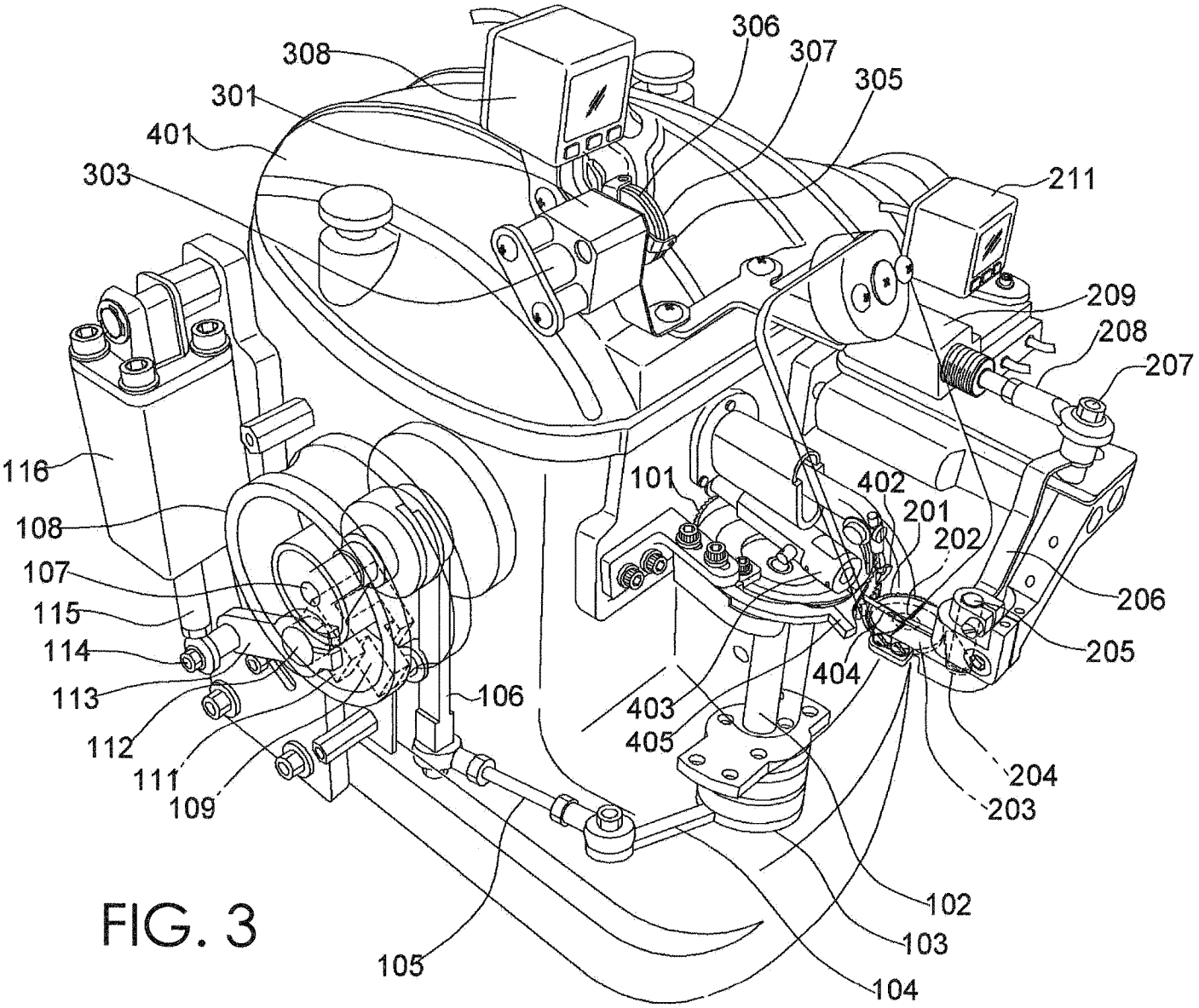
FIG. 3 is an enlarged perspective view illustrating a portion in which the sewing machine of FIG. 2 is performing a sewing operation, in accordance with aspects hereof.
Figure 4:
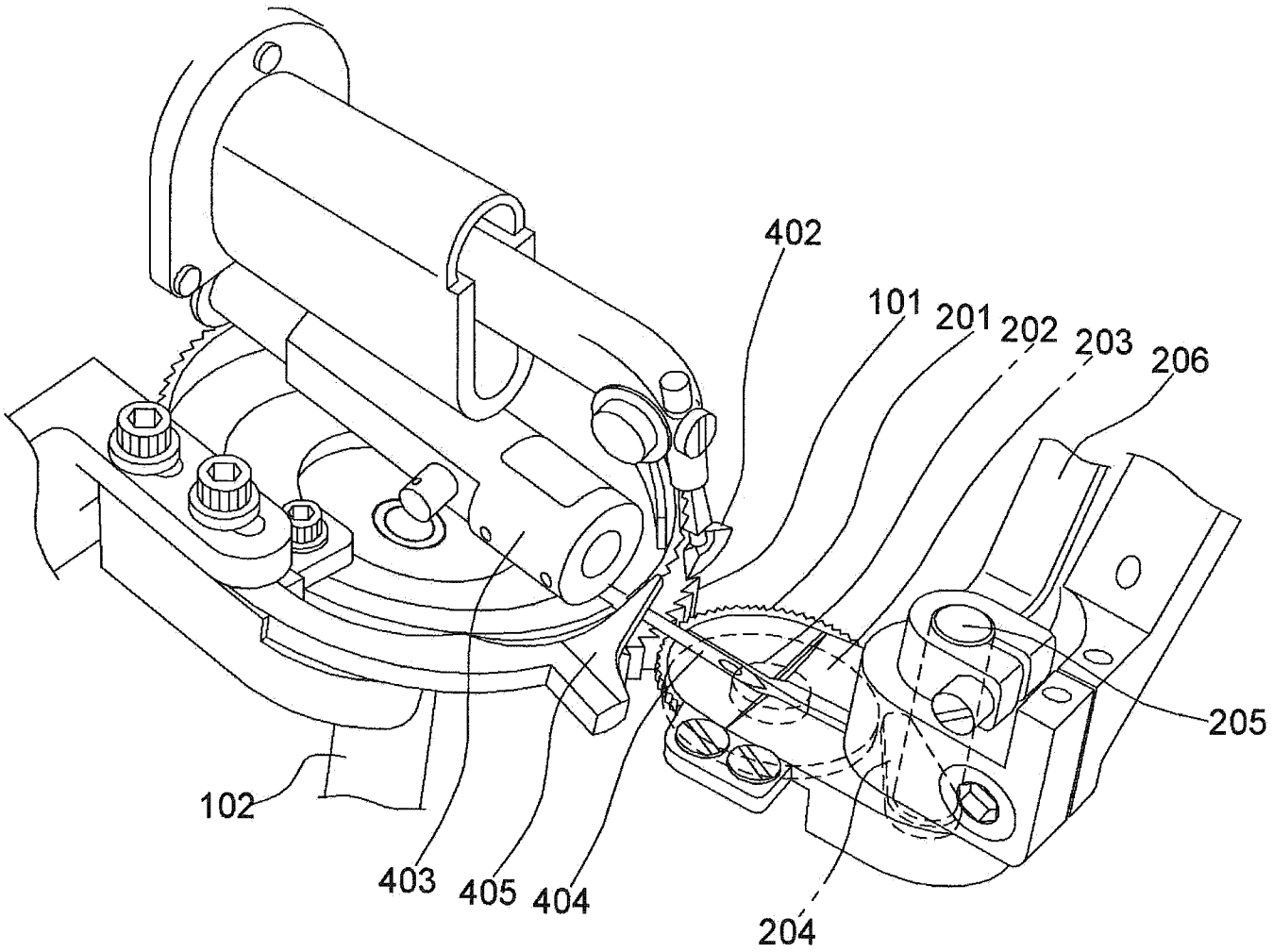
FIG. 4 is an enlarged perspective view of the sewing machine of FIG. 2 showing a gathering assembly, in accordance with aspects hereof.

FIG. 2 is a front view of the sewing machine 401 provided in a sewing machine 401, and FIG. 3 is an enlarged perspective view illustrating a portion in which the sewing is performed by a sewing machine 401.

The sewing machine 401 includes a transfer cup 101 connected to a central shaft 102, a transfer disc 201 disposed to face the transfer cup 101, a sewing needle 404 fixed to a transfer rod 403, and a guide plate 405. During sewing, an insole 501 and an upper of shoes 503 pass (e.g., transfer) between the transfer cup 101 and transfer disc 201 while markers 502 formed on the insole 501 and markers 504 formed on the upper of shoes 503 may be matched with each other. Then, the sewing needle 404 of the transfer rod 403 penetrates the insole 501 and the upper of shoes 503 in a direction orthogonal thereto to insert the sewing yarn 505, and a looper 402 tangles the sewing yarn 505 with the guide plate 405 for sewing. Therefore, the insole 501 and the upper of shoes 503 are sewn to be integrally formed with each other.

Herein, the insole 501 and the upper of shoes 503 have different lengths from each other at the outer peripheral portions thereof, as illustrated in FIG. 1. Accordingly, an object hereof is to match the insole 501 and the upper of shoes 503 having different outer peripheral portion lengths from each other. In order to accomplish this, the sewing machine 401 includes a brake device 203 mounted on the transfer disc 201 which performs the sewing while rotating together with the transfer cup 101. That is, the brake device 203 is coupled to the transfer disc 201 through a rotation axis 202 which is attached to a lower surface thereof.

In addition, the sewing machine 401 includes a brake pad 204 coupled to a lower end of a connecting axis 205 of a connecting pin 206. The brake pad 204 may selectively contact with the outer circumference of the brake device 203 so as to brake the transfer disc 201 by a frictional force generated between the brake device 203 and the brake pad 204.

Figure 5:
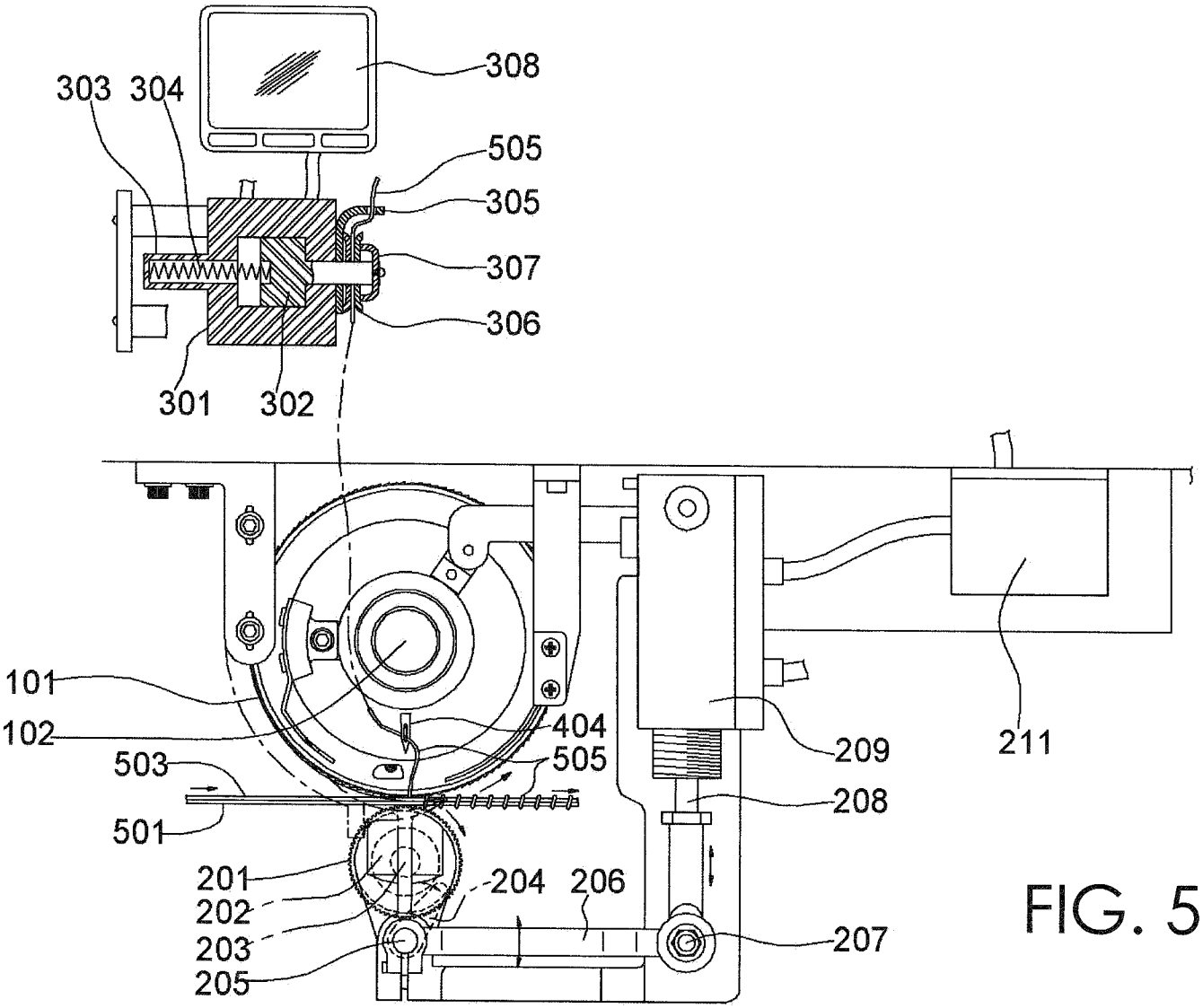
FIG. 5 is a schematic view of the sewing machine of FIG. 2 including a thread tensioner and a brake assembly, in accordance with aspects hereof.

In other words, in order to match the insole 501 having a shorter outer peripheral portion length with the upper of shoes 503 having a larger outer peripheral portion length, as illustrated in FIG. 5, the upper of shoes 503 contacting with the transfer cup 101 is contracted to be shortened thus resulting in wrinkles therein (i.e., gathering), whereas the insole 501 contacting with the transfer disc 201 is relaxed to be lengthened. Thereby, the insole 501 and the upper of shoes 503 are sewn while the outer peripheral portions thereof are matched with each other.

Therefore, when sewing sections having markers 502 *e-f* and *b-c* of the insole 501 and sections having markers 504 E-F and B-C of the upper of shoes 503, which have a gentle round (e.g., minimal curved perimeter), respectively, the worker performs the sewing in a normal mode. Whereas, when sewing sections having markers 502 *f-a-b* on a front side (e.g., toe end) and *c-d-e* on a rear side (e.g., heel end) of the insole 501 and sections having markers 504 F-A-B on the front side (e.g., toe end) and C-D-E on the rear side (e.g., heel end) of the upper of shoes 503, which have a sharp round (e.g., significant curved perimeter), respectively, the operator performs the sewing in a gathering mode by stepping on an operation pedal 212 (also referred to as a gathering assembly input pedal herein) as illustrated in FIG. 2.

When the worker steps on the operation pedal 212, the brake assembly comprising a second cylinder 209 is operated and a piston 208 is pulled to be moved rearward. Thereby, the connecting pin 206 connected to the piston 208 by a central pin 207 is rotated to rotate a connecting axis 205, and the brake pad 204 connected to the lower end of the connecting axis 205 is also rotated to press the outer circumference of the brake device 203 coupled to the rotation axis 202. As described above, the brake device 203 is stopped by the frictional force of the brake pad 204, and the transfer disc 201 connected to the brake device 203 through the rotation axis 202 is also stopped. Therefore, due to the stopping of the transfer disc 201, the insole 501 which is transferred and sewn by the transfer disc 201 is instantly stopped. In this case, due to the contacting with the upper of shoes 503 which is normally transferred by the transfer cup 101, the insole 501 is relaxed to be transferred at a low speed to be slowly sewn.

In this regard, one side of the upper of shoes 503 tends to be transferred by contacting with the rotating transfer cup 101, while the other side of the upper of shoes 503 tends to be stopped by the stopped insole 501. As a result, the upper of shoes 503 rotates against the frictional force between the insole 501 by the rotational force of the transfer cup 101 at a very reduced speed rather than smooth rotation, such that the upper of shoes 503 is compressed between the rotational force of the transfer cup 101 and a stop force of the insole 501 and sewn while there are intentionally introduced wrinkles therein.

Accordingly, the outer peripheral portion of the insole 501 having a smaller length and the outer peripheral portion of the upper of shoes 503 having a larger length are matched and sewn with each other.

Further, the sewing machine 401 includes a pressure display monitor 211 (e.g., gathering display monitor) electrically connected to the second cylinder 209, such that it is possible to confirm the pressure applied to the transfer disc 201 by a numerical value as an indication using the same. The pressure applied may be determined by one or more sensors associated with the second cylinder or one or more portions of the brake assembly. That is, when sewing the sections of the insole 501 and the upper of shoes 503 having the gentle round, it is possible to control the pressure by slightly stepping on the operation pedal 212 many times, which is in contrast to strongly pushing on the operation pedal 212 for a sharp round.

Figure 6:
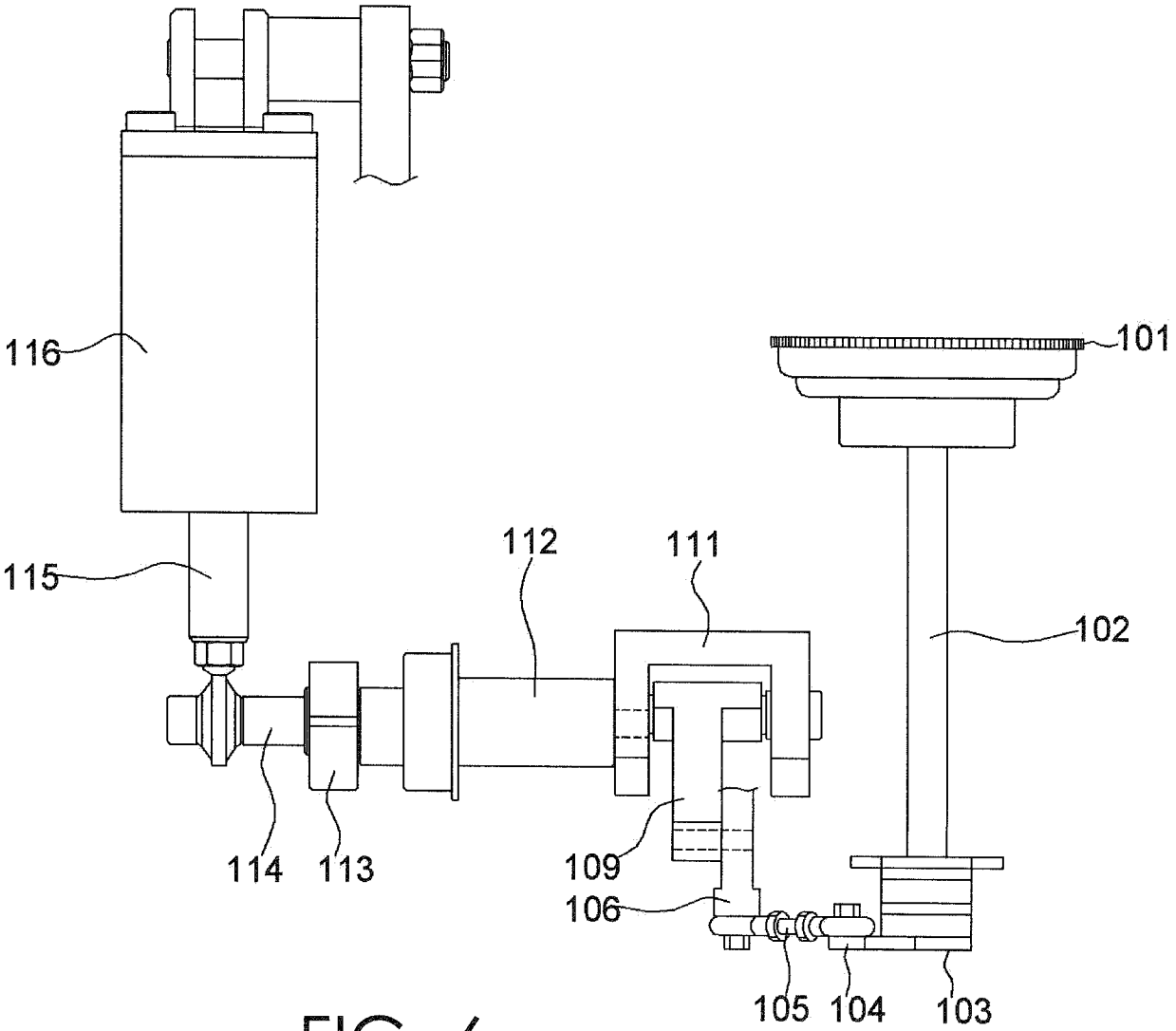
FIG. 6 is another schematic view of the sewing machine of FIG. 2 depicting a speed adjusting assembly, in accordance with aspects hereof.

Meanwhile, if the brake pad 204 operated by the operation pedal 212 presses the brake device 203 with an excessive force, the excessive force is transmitted to the transfer disc 201, thereby resulting in a case in which the transfer cup 101 may not be rotated as intended by the preset number of rotations by contacting with the transfer cup 101 due to the force transferred through the materials. In this case, in order to compensate (e.g., increase) the rotational force of the transfer cup 101, if operating a pressure control button 117 illustrated in FIG. 2, as illustrated in FIGS. 3 and 6, a first cylinder 116 (e.g., a pneumatic cylinder) is operated to move a piston 115 rearward causing an adjustment part 113 connected to the piston 115 through a connecting pin 114 is rotated to rotate an adjustment axis 112. The rotation of the adjustment axis causes a displacement adjustment part 111 connected to the adjustment axis 112 to be rotated, so as to rotate a moving part 109, which is eccentrically arranged inside of the displacement adjustment part 111, in a lower direction. Furthermore, due to an operation of a swing part 106 coupled to the moving part 109, a movement part 105 reciprocates a connecting part 104, such that the one-way clutch 103 is also rotated to rotate the central shaft 102 in one direction. Due to the rotation of the central shaft 102, the transfer cup 101 that is coupled to an upper end of the central shaft 102 may be rotated at a faster speed. As described above, since the lack of rotational force of the transfer cup 101 may be compensated by the speed adjusting assembly, it is possible to always perform the sewing in an optimal state.

In aspects a diameter of the transfer disc 201 is smaller than a diameter of the transfer cup 101. This reduction in diameter size of the transfer disc 201 limits physical interference with an operator's operation. Furthermore, having a smaller diameter limits, in some aspect, tangential force applied by a material resisting a braking effort by the brake assembly. Therefore, a difference in diameter between the transfer disc 201 and the transfer cup 101 may be advantageous.

Meanwhile, according to aspects hereof, it is possible to improve the sewing nonuniformity in which the sewing yarn 505 is partially tightly or loosely sewn according to a material of the sewn product or habits of the workers when sewing the insole 501 and the upper of shoes 503 with the following thread tensioner. That is, the tension of the sewing yarn 505 may be uniformly controlled matching with the sewn product.

In other words, as illustrated in FIG. 5 detailing aspect of the thread tensioner, the sewing yarn 505 passes through tightening plates 306 via a support 305 and is then connected to the sewing needle 404. Accordingly, a piston 302 within a third cylinder 301 is maintained in a forwardly moved state by an elastic member 304 within a support tube 303 in a normal mode, such that the sewing yarn 505 between pressing parts 307 may be loosely supplied.

In this state, if it is necessary to apply tension to the sewing yarn 505, when the operator operates a tension control button 309 of FIG. 2 (also referred to as operator tension input), an air pressure acts upon the third cylinder 301 (e.g., a pneumatic cylinder) to move the piston 302 rearward. Due to the rearward moving of the piston 302, the pressing parts 307 coupled to the piston 302 are moved rearward to compress the tightening plates 306, so as to press and apply tension to the sewing yarn 505. Thus, the tension of each sewing yarn 505 may be controlled and used depending on the material to provide uniformity in sewing. Further, the pressure applied to the sewing yarn 505 is displayed on a tension display monitor 308 (e.g., also referred to as a thread tension display), such that it is possible to supply the sewing yarn 505 having a uniform tension to the sewn product, and improve the convenience of the worker by improving the conformity of a tension strength of the sewing yarn 505 during sewing.

Exemplary clauses contemplated herein include, but are not limited to:

Clause 1. An apparatus for gathering of a sewing machine for shoemaking and controlling tension of sewing yarns thereof, which includes a transfer cup 101 connected to a central shaft 102, a transfer disc 201 disposed to face the transfer cup 101, a sewing needle 404 fixed to a transfer rod 403, and a guide plate 405, such that during sewing, an insole 501 and an upper of shoes 503 pass between the transfer cup 101 and the transfer disc 201 while markers 502 formed on the insole 501 and markers 504 formed on the upper of shoes 503 are matched with each other, then the sewing needle 404 of the transfer rod 403 penetrates the insole 501 and the upper of shoes 503 in a direction orthogonal thereto to insert the sewing yarn 505, and a looper 402 tangles the sewing yarn 505 with the guide plate 405 for sewing, thereby the insole 501 and the upper of shoes 503 are sewed to be integrally formed with each other. The apparatus comprising a brake assembly comprised of a brake device 203 coupled to a lower portion of the transfer disc 201 through a rotation axis 202 and a brake pad 204 coupled to a lower end of a connecting axis 205 of a connecting pin 206 so as to contact and brake an outer circumference surface of the transfer disc 201 by a frictional force generated between the brake device 203 and the brake pad 204, a pressing means which pivots the brake pad 204 to press the outer circumference surface of the brake device 203 which is coupled to the transfer disc 201. The apparatus further comprises a speed adjusting assembly configured to compensate a rotational force of the transfer cup 101 when the brake device 203 is pressed with an excessive force by the brake pad 204. The apparatus also comprised of a thread tensioner configured to uniformly control a tension of the sewing yarn 505 matching with a sewed product, by improving sewing nonuniformity in which the sewing yarn 505 is partially tightly or loosely sewed when sewing the insole 501 and the upper of shoes 503.

Clause 2. The apparatus according to clause 1, wherein the pressing means includes a connecting pin 206 whose lower end is coupled to an upper part of the connecting axis 205, a central pin 207 whose one end is coupled to an upper part of the connecting pin 206 and the other end is pivotally connected to a piston 208 of a second cylinder 209 mounted on a sewing machine 401, and a pressure display monitor 211 which is connected with the second cylinder 209 so as to numerically monitor a pressure applied to the brake device 203 by the brake pad 204 through the second cylinder 209.

Clause 3. The apparatus according to any of clauses 1 and 2, wherein the speed adjusting assembly includes a connecting part 104 connected to a lower end of the central shaft 102 whose upper end is coupled to the transfer cup 101 together with a one-way clutch; a movement part 105 whose one end is pivotally connected to the connecting part 104 to reciprocate the connecting part 104 so as to rotate the central shaft 102; a swing part 106 whose lower end is connected to the movement part 105 and upper end is coupled to a driving shaft 107 so as to swing the movement part 105; a moving part 109 connected with the swing part 106 so as to swing the swing part 106; a displacement adjustment part 111 of an adjustment axis 112, with which the moving part 109 is eccentrically coupled; and an adjustment part 113 whose one end is coupled to one end of the adjustment axis 112 and the other end is connected to a piston 115 of a first cylinder 116 mounted on the sewing machine 401 through a connecting pin 114.

Clause 4. The apparatus according to any of clauses 1 through 3, wherein the thread tensioner includes: a pressing part 307 which is coupled to a piston 302 of a third cylinder 301 and contacts with outer tightening plates 306 so that the tightening plates 306 presses the sewing yarn 505 which passes through the tightening plates 306 via a support 305 and is then connected to the sewing needle 404; an elastic member 304 which is elastically installed within a support tube 303 of the third cylinder 301 to elastically support the piston 302 so that the pressing part 307 presses the tightening plates 306; and a tension display monitor 308 which is connected to the third cylinder 301 so as to numerically monitor a pressure applied to sewing yarn 505 by the third cylinder 301.

From the foregoing, it will be seen that aspects described herein are well adapted to attain all the ends and objects hereinabove set forth together with other advantages which are obvious and which are inherent to the structure. Since many possible aspects described herein may be made without departing from the scope thereof, it is to be understood that all matter herein set forth or shown in the accompanying drawings is to be interpreted as illustrative and not in a limiting sense.

What is claimed is:

1. A sewing machine comprising:

a thread tensioner, the thread tensioner comprising a tightening plate and a pressing part, the pressing part is adjustably positioned relative to the tightening plate to allow adjustment of a tension experienced by a thread extending between the pressing part and the tightening plate;

a gathering assembly, the gathering assembly comprised of a transfer cup and a transfer disc between which an intended article to be sewn is able to pass;

and a brake assembly, the brake assembly mechanically engaged with the transfer disc to variably adjust rotational speed of the transfer disc through frictional interaction, wherein the transfer cup has a faster transfer speed than the transfer disc as the brake assembly applies frictional interaction to the transfer disc.

2. The sewing machine of claim 1, further comprising a speed adjusting assembly mechanically engaged with the transfer cup to variably adjust rotational speed of the transfer cup.

3. The sewing machine of claim 2, further comprising an operator speed input controllably linked with the speed adjusting assembly to control rotational speed of the transfer cup.

4. The sewing machine of claim 1, further comprising a thread tension display, the thread tension display adapted to display an indication of a tension supplied by the thread tensioner.

5. The sewing machine of claim 1, further comprising an operator tension input controllably linked with the thread tensioner allowing for adjustment of tension.

6. The sewing machine of claim 1, further comprising a gathering display adapted to display an indication of a pressure applied by the brake assembly.

7. The sewing machine of claim 1, further comprising a gathering assembly input pedal, the gathering assembly input pedal operationally coupled with the brake assembly to control an adjustment of the rotational speed of the transfer disc by the brake assembly.

8. The sewing machine of claim 1, wherein the transfer cup has a larger diameter than the transfer disc.

9. The sewing machine of claim 1, wherein the brake assembly is comprised of a pneumatic cylinder mechanically coupled with a brake pad, the brake pad producing, in part, the frictional interaction.

10. The sewing machine of claim 1, wherein the thread tensioner is comprised of a pneumatic cylinder mechanically coupled with the pressing part to adjustably position the pressing part relative to the tightening plate.

11. A sewing machine comprising:

a gathering assembly, the gathering assembly comprising a transfer cup and a transfer disc between which an intended article to be sewn is able to pass, wherein the transfer disc has a smaller diameter than the transfer cup;

a brake assembly, the brake assembly mechanically engaged with the transfer disc to variably adjust rotational speed of the transfer disc through frictional interaction;

and a speed adjusting assembly mechanically engaged with the transfer cup to variably adjust rotational speed of the transfer cup, wherein the transfer cup has a faster transfer speed than the transfer disc as the brake assembly applies frictional interaction to the transfer disc.

12. The sewing machine of claim 11, further comprising:

(A) an operator speed input controllably linked with the speed adjusting assembly to control rotational speed of the transfer cup; and (B) a gathering assembly input pedal, the gathering assembly input pedal operationally coupled with the brake assembly to control an adjustment of the rotational speed of the transfer disc by the brake assembly.

13. The sewing machine of claim 12, further comprising a gathering display adapted to display an indication of a pressure applied by the brake assembly.

14. A method of operating a sewing machine, the method comprising:

transferring a first material and a second material through a gathering assembly, the gathering assembly comprised of a transfer cup and a transfer disc;

applying a brake to the transfer disc, the brake applying friction interaction to reduce a transfer speed of the second material relative to a transfer speed of the first material;

stitching the first material with the second material while applying the brake;

reducing an application of the brake to the transfer disc, the first material and the second material having a same transfer speed;

and stitching the first material with the second material while reducing an application of the brake.

15. The method of claim 14, further comprising increasing a speed of the transfer cup with a speed adjusting assembly mechanically engaged with the transfer cup.

16. The method of claim 14, wherein applying the brake generates wrinkles in the first material when stitched with the second material.

17. The method of claim 14, further comprising aligning a first marker on the first material with a first marker on the second material prior to stitching the first material with the second material while applying the brake and aligning a second marker on the first material with a second marker on the second material after stitching the first material with the second material while applying the brake.

18. The method of claim 14, wherein the first material is at least a portion of a footwear upper and the second material is at least a portion of an insole.

* * * * *